US008727338B2

(12) United States Patent
Hayakawa

(10) Patent No.: US 8,727,338 B2
(45) Date of Patent: May 20, 2014

(54) SUPPLY DEVICE AND IMAGE FORMING APPARATUS

(75) Inventor: Yuji Hayakawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/557,867

(22) Filed: Jul. 25, 2012

(65) Prior Publication Data

US 2013/0241139 A1 Sep. 19, 2013

(30) Foreign Application Priority Data

Mar. 19, 2012 (JP) ..... 2012-061921

(51) Int. Cl.
*B65H 3/06* (2006.01)

(52) U.S. Cl.
USPC ..... 271/117; 271/121

(58) Field of Classification Search
USPC ..... 271/117, 118, 121
See application file for complete search history.

(56) References Cited

U.S. PATENT DOCUMENTS 7,571,905 B2 8/2009 Kim
2002/0074711 A1 6/2002 Higaki

FOREIGN PATENT DOCUMENTS

JP 2002-179274 A 6/2002

*Primary Examiner* — Michael McCullough
(74) *Attorney, Agent, or Firm* — Sughrue Mion, PLLC

(57) ABSTRACT

A supply device includes a supply roller, a prevention member, a restriction member, and a rotatably supported rotary member. The supply roller supplies a medium. When in a first posture, the prevention member prevents the medium from being supplied by the supply roller. When in a second posture different from the first posture, the prevention member allows the medium to be supplied by the supply roller. When located at a determined position, the restriction member restricts a shift of the prevention member from the first posture to the second posture. When rotated, the rotary member moves the restriction member located at the determined position and releases the restriction on the prevention member imposed by the restriction member, and thereafter moves the supply roller and brings the supply roller into contact with the medium.

5 Claims, 5 Drawing Sheets

SUPPLY DEVICE AND IMAGE FORMING APPARATUS

CROSS-REFERENCE TO RELATED APPLICATIONS

This application is based on and claims priority under 35 USC 119 from Japanese Patent Application No. 2012-061921 filed Mar. 19, 2012.

BACKGROUND

1. Technical Field

The present invention relates to a supply device and an image forming apparatus.

2. Summary

According to an aspect of the invention, there is provided a supply device including a supply roller, a prevention member, a restriction member, and a rotatably supported rotary member. The supply roller supplies a medium. When in a first posture, the prevention member prevents the medium from being supplied by the supply roller. When in a second posture different from the first posture, the prevention member allows the medium to be supplied by the supply roller. When located at a determined position, the restriction member restricts a shift of the prevention member from the first posture to the second posture. When rotated, the rotary member moves the restriction member located at the determined position and releases the restriction on the prevention member imposed by the restriction member, and thereafter moves the supply roller and brings the supply roller into contact with the medium.

BRIEF DESCRIPTION OF THE DRAWINGS

An exemplary embodiment of the present invention will be described in detail based on the following figures, wherein.

DETAILED DESCRIPTION

1. Exemplary Embodiment

1-1. Overall Configuration

Figure 1:
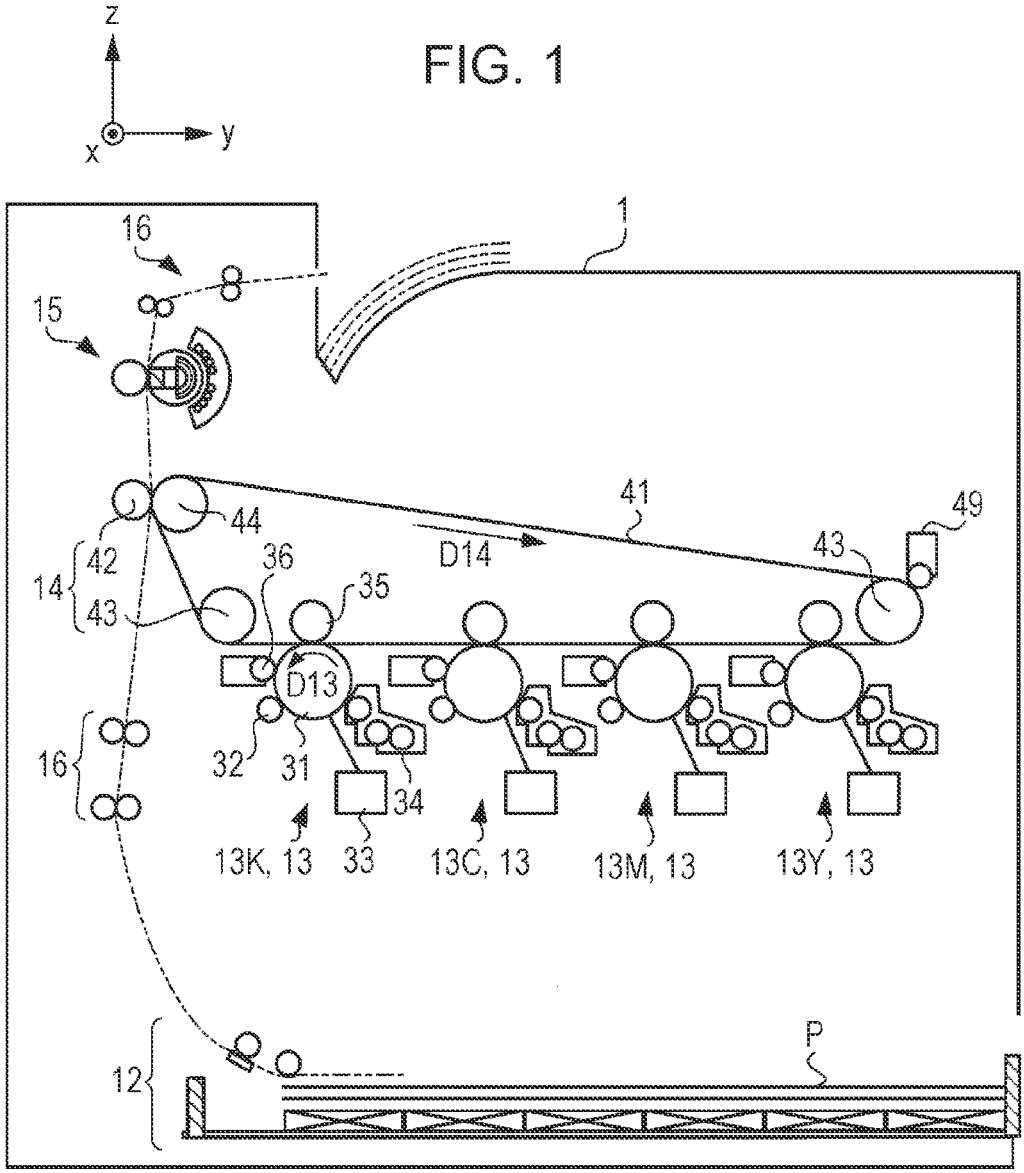
FIG. 1 is a diagram illustrating an overall configuration of an image forming apparatus according to the present exemplary embodiment.

FIG. 1 is a diagram illustrating an overall configuration of an image forming apparatus 1 according to the present exemplary embodiment. As illustrated in the drawing, the image forming apparatus 1 includes a supply section 12, developing units 13Y, 13M, 13C, and 13K, a transfer unit 14, a heating unit 15, and a transport unit 16. Alphabetical characters Y, M, C, and K in reference symbols indicate configurations corresponding to yellow, magenta, cyan, and black toners, respectively. The developing units 13Y, 13M, 13C, and 13K are different only in toner to be used, and are not substantially different in configuration. In the following, when it is not particularly necessary to distinguish between the developing units 13Y, 13M, 13C, and 13K, the developing units 13Y, 13M, 13C, and 13K will be referred to as the "developing units 13," with omission of the alphabetical characters at the ends of the reference symbols indicating toner colors.

The supply section 12 includes a container and a supply unit. The container stores sheets P each cut into a predetermined size and serving as a medium. In accordance with an instruction from a not-illustrated controller, the sheets P stored in the container are extracted one by one and supplied to the transport unit 16 by the supply unit. The medium is not limited to a paper sheet, and may be a sheet made of a resin, for example. That is, it suffices if the medium allows an image to be recorded on a surface thereof.

The transport unit 16 includes transport rollers. The transport unit 16 transports to the transfer unit 14 the sheet P supplied from the supply section 12. The transport unit 16 further transports to the outside of a housing of the image forming apparatus 1 the sheet P having passed the transfer unit 14 and the heating unit 15.

Each of the developing units 13 includes a photoconductor drum 31, a charging device 32, an exposure device 33, a developing device 34, a first transfer roller 35, and a drum cleaner 36. The photoconductor drum 31 is an image carrier including a charge generating layer and a charge transporting layer, and is rotated in the direction of an arrow D13 in the drawing by a not-illustrated drive unit. The charging device 32 charges a surface of the photoconductor drum 31. The exposure device 33 includes a laser light emission source and a polygon mirror (both not illustrated). Under a control of the controller, the exposure device 33 radiates laser light according to image data to the photoconductor drum 31 charged by the charging device 32. Thereby, latent images are held by the respective photoconductor drums 31. The above-described image data may be acquired by the controller from an external device via a not-illustrated communication unit. The external device may be, for example, a reading device which reads an original image or a storage device which stores data representing an image.

The developing device 34 stores a two-component developer containing a toner of one of the Y, M, C, and K colors and a magnetic carrier made of ferrite powder or the like. Further, when the tips of spikes of a magnetic brush formed in the developing device 34 come into contact with the surface of the photoconductor drum 31, the toner adheres to a portion of the surface of the photoconductor drum 31 exposed to the laser light by the exposure device 33, i.e., adheres to an image area corresponding to the electrostatic latent image. Thereby, an image is formed (developed) on the photoconductor drum 31.

The first transfer roller 35 generates a predetermined potential difference at a position at which an intermediate transfer belt 41 of the transfer unit 14 faces the photoconductor drum 31. With this potential difference, the first transfer roller 35 transfers the image to the intermediate transfer belt 41. The drum cleaner 36 removes untransferred toner remaining on the surface of the photoconductor drum 31 after the transfer of the image, and discharges the surface of the photoconductor drum 31. That is, the drum cleaner 36 removes unnecessary toner and charge from the photoconductor drum 31 in preparation for the next image formation.

The transfer unit 14 includes the intermediate transfer belt 41, a second transfer roller 42, belt transport rollers 43, and a backup roller 44, and transfers the image formed by the developing unit 13 to the sheet P of a sheet type determined in accordance with an operation by a user. The intermediate transfer belt 41 is an endless belt member. The belt transport rollers 43 and the backup roller 44 stretch the intermediate transfer belt 41. At least one of the belt transport rollers 43 and the backup roller 44 is provided with a drive unit (not illustrated) to move the intermediate transfer belt 41 in the direction of an arrow D14 in the drawing. Any of the belt transport rollers 43 and the backup roller 44 not having the drive unit is driven to rotate by the movement of the intermediate transfer belt 41. In accordance with the movement and rotation of the intermediate transfer belt 41 in the direction of the arrow D14 in the drawing, the image on the intermediate transfer belt 41 is moved to an area between the second transfer roller 42 and the backup roller 44.

With a potential difference between the second transfer roller 42 and the intermediate transfer belt 41, the second transfer roller 42 transfers the image on the intermediate transfer belt 41 to the sheet P transported from the transport unit 16. A belt cleaner 49 removes untransferred toner remaining on a surface of the intermediate transfer belt 41. Then, the transfer unit 14 and the transport unit 16 transport to the heating unit 15 the sheet P having the image transferred thereto. The combination of the developing units 13 and the transfer unit 14 is an example of an image forming unit of the invention, which forms an image on a medium.

The heating unit 15 includes, for example, a magnetic field generating circuit which generates a magnetic field, a heating belt which generates heat by electromagnetic induction caused by the action of the generated magnetic field, and a pressure roller which transports the sheet P by nipping the sheet P between the heating belt and the pressure roller. The heating unit 15 heats the sheet P to thereby fix the image transferred to the sheet P.

1-2. Configuration of Supply Section

Figure 2:
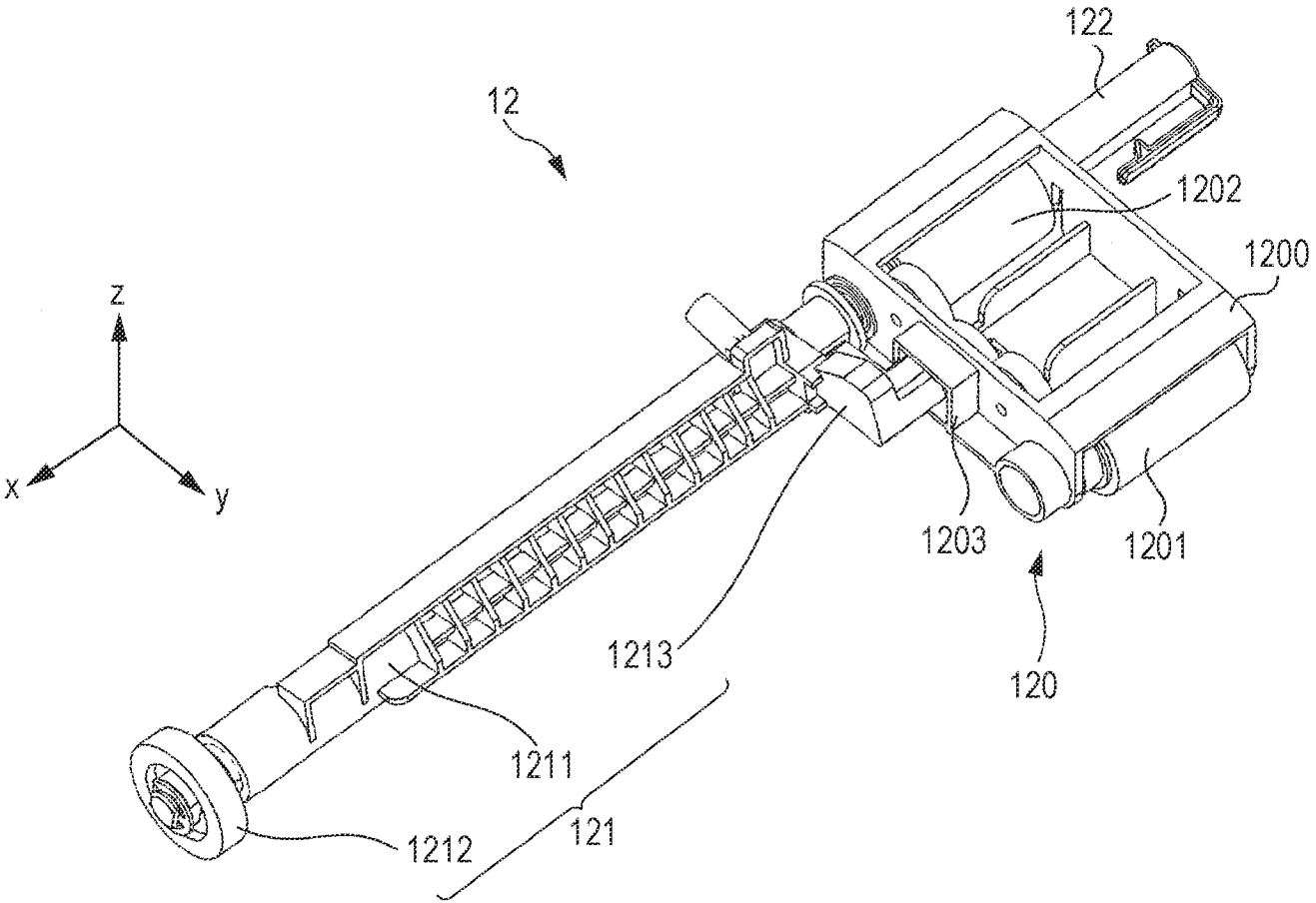
FIG. 2 is a diagram illustrating an overview of a supply section.

FIG. 2 is a diagram illustrating an overview of the supply section 12. In the following drawings, to describe the arrangement of respective configurations of the supply section 12, the space in which the configurations are arranged will be illustrated as a right-handed xyz coordinate space. Further, among coordinate symbols illustrated in the drawings, a symbol of a black dot drawn inside a white circle represents an arrow directed from the far side toward the near side in the drawings. In the space, directions along the x-axis will be referred to as the x-axis directions. Further, one of the x-axis directions in which the x-component is increased will be referred to as the +x direction, and the other x-axis direction in which the x-component is reduced will be referred to as the −x direction. Further, y-axis directions, a +y direction, a −y direction, z-axis directions, a +z direction, and a −z direction are also defined in terms of the y-component and the z-component, respectively. When the sheet P passes the supply section 12, the sheet P is transported in the −y direction. Further, the x-axis directions correspond to the width direction of the sheet P.

A supply unit 120 includes a housing 1200, a supply roller 1201, a separation roller 1202, and a lever receiving member 1203. The housing 1200 holds therein the supply roller 1201 and the separation roller 1202 by supporting respective shafts of the supply roller 1201 and the separation roller 1202. The lever receiving member 1203 forms an internal space with plate-shaped members combined together, and is provided to a side wall of the housing 1200.

A drive force transmitting mechanism 121 includes a shaft 1211, a gear 1212, and a lever 1213. The shaft 1211 is a cylindrical member extending in the x-axis directions. The gear 1212 is rotated by a not-illustrated driving device. When rotated, the gear 1212 transmits rotational force thereof to the shaft 1211 provided coaxially with the gear 1212. The lever 1213 is provided around the circumference of the shaft 1211. The lever 1213 includes a cylindrical base member **1213*t* covering a side surface of the shaft 1211 and a rod-shaped member 1213*s* radially extending from the cylindrical base member 1213*t*. The cylindrical base member 1213*t* included in the lever 1213 is provided coaxially with the shaft 1211. The cylindrical base member 1213*t* rotates with an inner wall surface thereof sliding on the side surface of the shaft 1211. Further, the rod-shaped member 1213*s* of the lever 1213 rotates in accordance with the rotation of the cylindrical base member 1213*t***.

Figure 3:
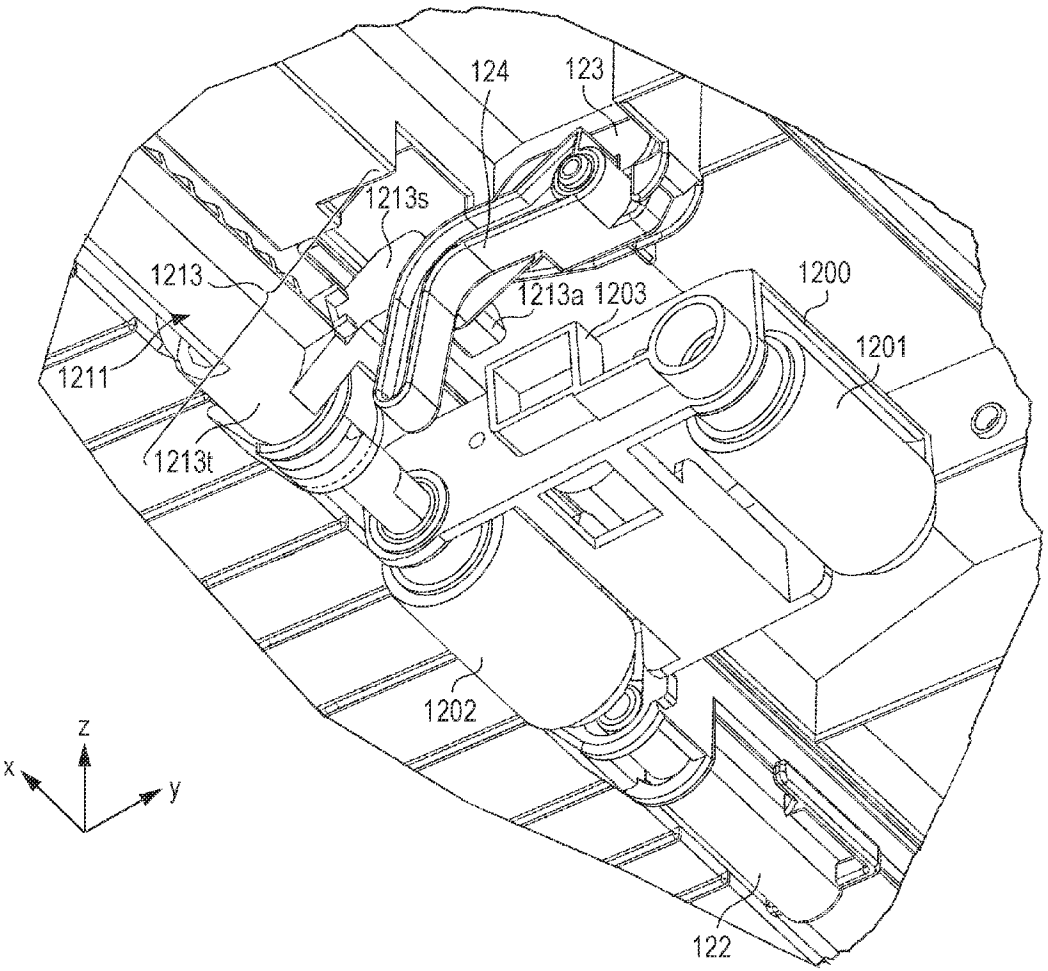
FIG. 3 is an assembly diagram of the supply section.

FIG. 3 is an assembly diagram of the supply section 12. The shaft of the separation roller 1202 is supported by the housing 1200, and projects from an outer wall of the housing 1200. The projecting portion of the shaft is inserted into an end portion of the shaft 1211 opposite to an end portion of the shaft 1211 provided with the gear 1212. Thereby, the shaft of the separation roller 1202 is connected to the shaft 1211. Further, the rotational force of the gear 1212 is transmitted to the separation roller 1202 via the shaft 1211.

An end portion of the rod-shaped member **1213*s* of the lever 1213 far from the cylindrical base member 1213*t* is provided with a projecting portion 1213*a* extending in the −x direction. The projecting portion 1213*a* is inserted into the internal space of the above-described lever receiving member 1203**.

A fastening member 122 is connected to a portion of the shaft of the separation roller 1202 opposite to the portion of the shaft inserted into the end portion of the shaft 1211. The fastening member 122 fastens the supply unit 120 to prevent the supply unit 120 from coming off the shaft 1211 in a direction along the axis of the shaft 1211.

A stopper 124 (prevention member) comes into contact with respective leading end portions of the sheets P in the direction of supplying the sheets P stored in the container (supply direction), and prevents the sheet P from being supplied in the supply direction. Further, the stopper 124 aligns the leading end portions of the stacked plural sheets P.

When a locking member 123 is located at a determined position, the locking member 123 restricts the movement of the stopper 124 (restriction member).

Figure 4:
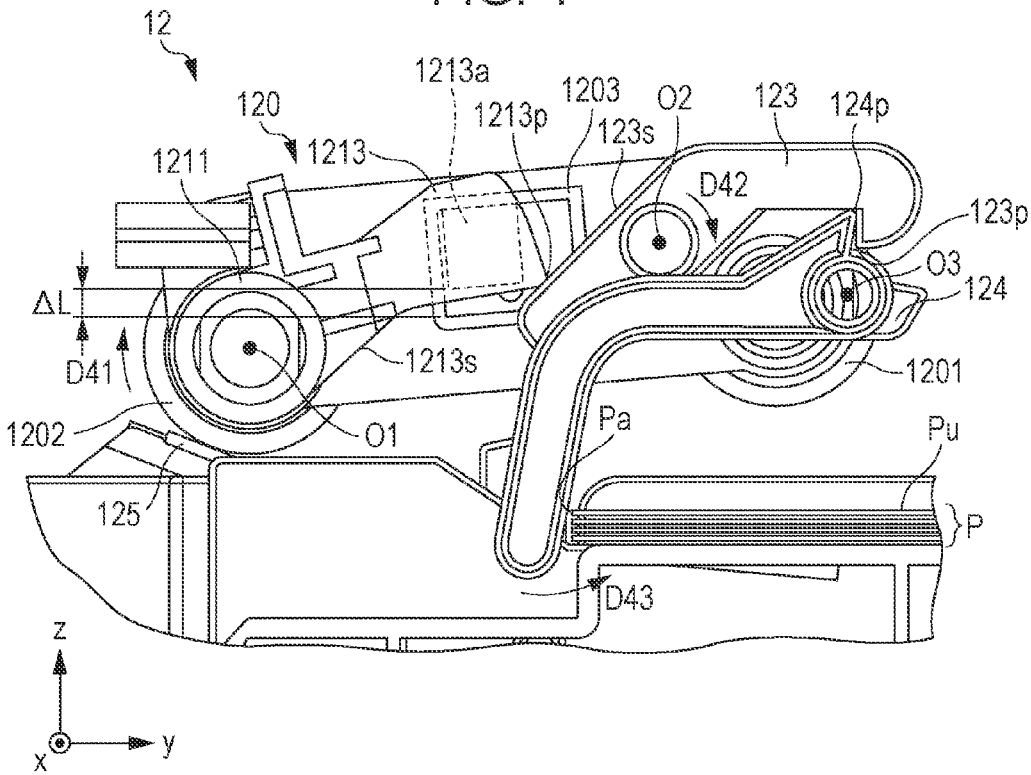
FIG. 4 is a diagram illustrating the supply section in a standby state.

Operations of the stopper 124 and the locking member 123 will be described in detail. FIG. 4 is a diagram illustrating the supply section 12 in a standby state in which the sheets P are not supplied by the supply unit 120. FIG. 4 illustrates the supply section 12 in the standby state, as viewed in the −x direction. The projecting portion **1213*a* of the lever 1213 is inserted in the lever receiving member 1203. Thus, the supply unit 120 moves in conjunction with the movement of the lever 1213. The lever 1213 is provided to rotate around an axis O1 of the shaft 1211. Therefore, the supply unit 120 moves around the axis O1**.

A separation plate 125 is provided under (on the −z direction side of) the separation roller 1202 provided in the supply unit 120. The distance between the separation plate 125 and the separation roller 1202 is adjusted. If the plural sheets P are supplied at one time to the position between the separation plate 125 and the separation roller 1202, the separation plate 125 allows only the uppermost sheet P of the sheets P to pass the position, and blocks the other sheets P located under the sheet P.

The cylindrical base member **1213*t* is pressed (biased) in the direction of an arrow D41 centering around the axis O1 by a not-illustrated resilient member, such as a coil spring. Further, in the standby state, the cylindrical base member 1213*t*** is stopped by a not-illustrated hook-shaped member in a direction against the force of the above-described resilient member. As a result, the rod-shaped member 1213*s* provided to radially extend from the cylindrical base member 1213*t* is placed at the position illustrated in FIG. 4.

The locking member 123 is supported by a not-illustrated frame of the image forming apparatus 1 to rotate around an axis O2 extending in the x-axis directions. The mass of a portion of the locking member 123 located on the +y direction side of the axis O2 is greater than the mass of a portion of the locking member 123 located on the −y direction side of the axis O2. Due to the gravity, therefore, the locking member 123 rotates around the axis O2 in the direction of an arrow D42. A +y direction-side end portion of the locking member 123 is hook-shaped, and a leading end portion 123*p* of the locking member 123 is in contact with the stopper 124. Therefore, the rotation of the locking member 123 in the direction of the arrow D42 is stopped at the position illustrated in FIG. 4.

The stopper 124 is supported by the not-illustrated frame of the image forming apparatus 1 to rotate around an axis O3 extending in the x-axis directions. The mass of a portion of the stopper 124 located on the −y direction side of the axis O3 is greater than the mass of a portion of the stopper 124 located on the +y direction side of the axis O3. Due to the gravity, therefore, the stopper 124 rotates around the axis O3 in the direction of an arrow D43. A portion of the stopper 124 facing the locking member 123 is hook-shaped, and a leading end portion 124*p* of the stopper 124 is engaged with the hook-shaped end portion of the locking member 123. Therefore, the rotation of the stopper 124 in the direction of the arrow D43 is stopped when the stopper 124 is in the posture illustrated in FIG. 4 (hereinafter referred to as the first posture). With the stopper 124 stopped by the locking member 123 to maintain the first posture, respective leading end portions Pa of the plural sheets P stored in the container are aligned along the stopper 124. Further, in the first posture, the stopper 124 prevents the sheets P from being supplied by the supply roller 1201.

Figure 5:
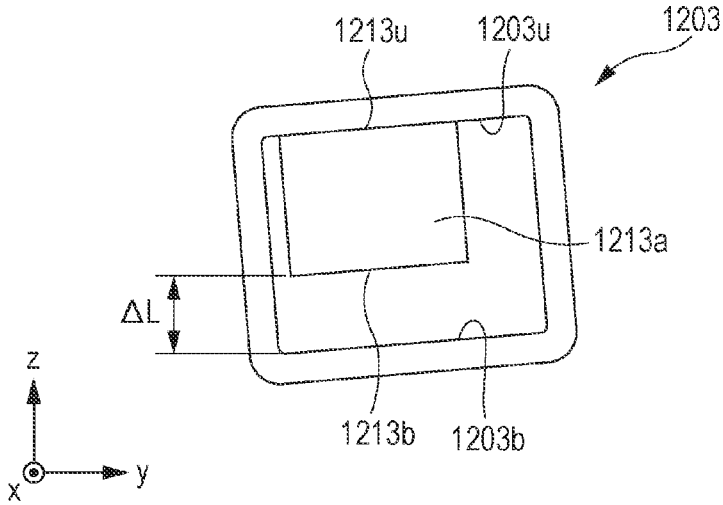
FIG. 5 is a diagram for describing a projecting portion inserted in a lever receiving member.

The projecting portion 1213*a* is formed to be smaller than the internal space of the lever receiving member 1203. FIG. 5 is a diagram for describing the projecting portion 1213*a* inserted in the lever receiving member 1203. FIG. 5 illustrates the lever receiving member 1203 and the projecting portion 1213*a* in the standby state of the supply unit 120, as viewed in the −x direction. In the standby state, an upper surface 1213*u* of the projecting portion 1213*a* supports a top plate 1203*u* of the lever receiving member 1203 to press the top plate 1203*u* upward in the +z direction. Further, the distance between the top plate 1203*u* and a bottom plate 1203*b* of the lever receiving member 1203 is greater than the distance between the upper surface 1213*u* and a lower surface 1213*b* of the projecting portion 1213*a* by a distance ΔL. In the standby state, therefore, a clearance having the distance ΔL is present between the lower surface 1213*b* of the projecting portion 1213*a* and the bottom plate 1203*b* of the lever receiving member 1203.

A leading end portion 1213*p* illustrated in FIG. 4 is a portion of the rod-shaped member 1213*s* of the lever 1213 facing the locking member 123. When the lever 1213 rotates in the direction of the arrow D41, the leading end portion 1213*p* of the lever 1213 comes into contact with the locking member 123, and rotates the locking member 123 in a direction opposite to the direction of the arrow D42. A surface of the locking member 123, with which the leading end portion 1213*p* comes into contact, will be referred to as the contact surface 123*s*. The leading end portion 1213*p* comes into contact with the contact surface 123*s*, and presses the contact surface 123*s* in the −z direction while sliding thereon.

1-3. Operation

An operation of the supply section 12 will be described. When the supply unit 120 of the supply section 12 rotates and the supply roller 1201 descends toward an upper surface Pu of the sheets P, the following phenomena sequentially occur.

In a first phenomenon, the upper surface 1213*u* of the projecting portion 1213*a* separates from the top plate 1203*u* of the lever receiving member 1203. In a second phenomenon, the leading end portion 1213*p* of the lever 1213 hits against the contact surface 123*s* of the locking member 123. In a third phenomenon, the leading end portion 123*p* of the locking member 123 separates from the leading end portion 124*p* of the stopper 124. In a fourth phenomenon, the lower surface 1213*b* of the projecting portion 1213*a* hits against the bottom plate 1203*b* of the lever receiving member 1203. In a fifth phenomenon, the supply roller 1201 hits against the upper surface Pu of the sheets P. The above phenomena will be described below.

Figure 6:
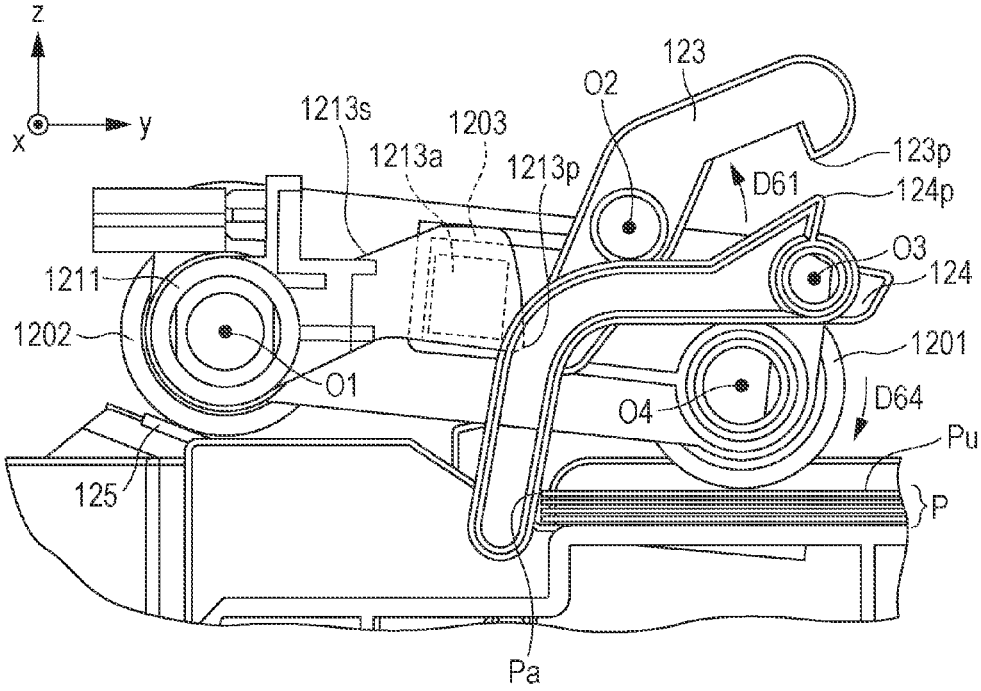
FIG. 6 is a diagram for describing a state in which a locking member is separated from a stopper.

FIG. 6 is a diagram for describing a state in which the lever 1213 has rotated and separated the locking member 123 from the stopper 124. When the foregoing hook-shaped member separates from the cylindrical base member 1213*t*, the lever 1213 is rotated in the direction of the arrow D41 illustrated in FIG. 4 by the force of the resilient member. In this process, the supply unit 120 maintains the position illustrated in FIG. 4 owing to the inertia or the upward pressing force of the not-illustrated resilient member, such as a spring, acting in the +z direction. The supply unit 120 and the lever 1213 are not connected to each other. Therefore, the upper surface 1213*u* of the projecting portion 1213*a* separates from the top plate 1203*u* of the lever receiving member 1203 (first phenomenon).

Then, in accordance with the rotation of the lever 1213 in the direction of the arrow D41, the leading end portion 1213*p* comes into contact with and presses the contact surface 123*s* of the locking member 123 (second phenomenon). Therefore, the locking member 123 is moved from the position illustrated in FIG. 4 (a determined position). That is, as illustrated in FIG. 6, the locking member 123 rotates around the axis O2 in the direction of an arrow D61 (a direction opposite to the direction of the arrow D42 illustrated in FIG. 4). Thereby, the leading end portion 123*p* of the locking member 123 is lifted upward in the +z direction above the leading end portion 124*p* of the stopper 124, and the locking member 123 and the stopper 124 separate from each other (third phenomenon). As a result, the restriction on the stopper 124 imposed by the locking member 123 is released.

When the lever 1213 further rotates in the direction of the arrow D41 illustrated in FIG. 4, the lower surface 1213*b* of the projecting portion 1213*a* hits against the bottom plate 1203*b* of the lever receiving member 1203 (fourth phenomenon). Thereby, the supply unit 120 maintained at the position illustrated in FIG. 4 moves, and the supply roller 1201 descends toward the upper surface Pu of the sheets P. As a result, the supply roller 1201 comes into contact with the upper surface Pu of the sheets P (fifth phenomenon). The supply roller 1201 having come into contact with the upper surface Pu of the sheets P is rotated around an axis O4 in the direction of an arrow D64 illustrated in FIG. 6 by a not-illustrated drive mechanism. Thereby, the uppermost stacked sheet P of the plural sheets P stored in the container is supplied in the −y direction.

Figure 7:
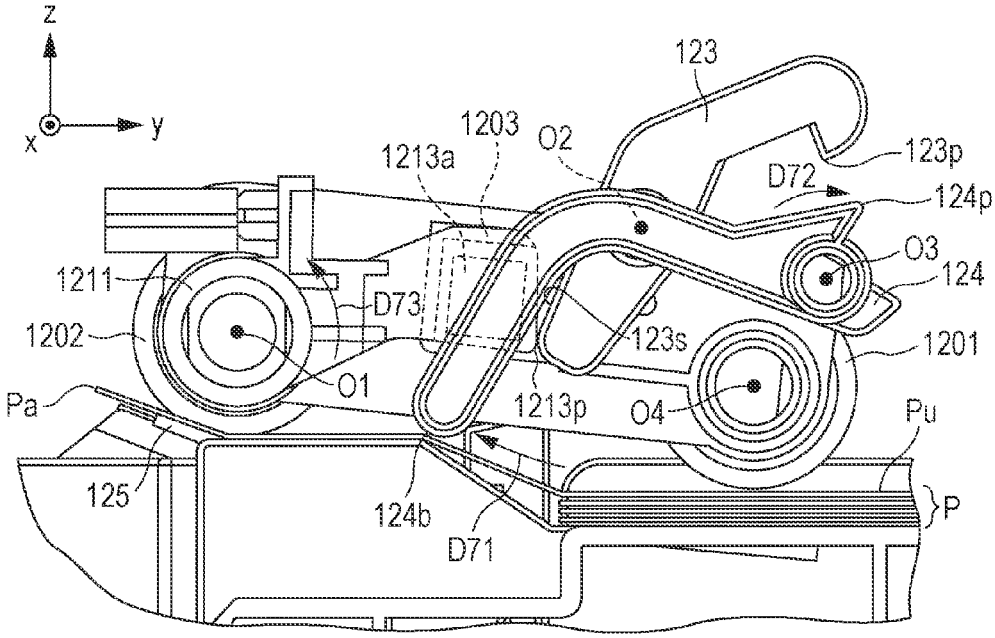
FIG. 7 is a diagram for describing the movement of the stopper performed when a sheet is supplied.

FIG. 7 is a diagram for describing the movement of the stopper 124 performed when the sheet P is supplied. As described above, the third phenomenon precedes the fifth phenomenon. Therefore, the stopper 124 is released from the load of the locking member 123 before the sheet P is moved by the supply roller 1201. When the sheet P is supplied, therefore, the stopper 124 is rotatable around the axis O3. That is, the stopper 124 allows the sheet P (medium) to be supplied by the supply roller 1201.

When the supply roller 1201 supplies the sheet P in the direction of an arrow D71 illustrated in FIG. 7, the leading end portion Pa of the sheet P at the leading end in the supply direction of the sheet P presses the stopper 124. With this pressing force, the stopper 124 rotates around the axis O3 in the direction of an arrow D72 illustrated in FIG. 7. As a result, an end portion 124*b* of the stopper 124, which is far from the axis O3 and aligns the leading end portions Pa of the sheets P in the standby state, is lifted upward in the +z direction, and the stopper 124 takes the posture illustrated in FIG. 7 (hereinafter referred to as the second posture). The stopper 124 in the second posture is unable to prevent the supply of the sheet P, and the sheet P is supplied to the separation roller 1202. If a bundle of plural sheets P reaches the separation plate 125, the sheets P are separated by the separation plate 125, and are transported one by one to the transport unit 16 by the separation roller 1202. While the sheet P is being supplied by the supply unit 120 and in contact with the end portion 124*b* of the stopper 124, the stopper 124 is in the second posture. Then, after the sheet P passes the end portion 124*b*, the stopper 124 returns to the first posture illustrated in FIG. 6.

If the supply of the sheet P by the supply unit 120 is completed when the stopper 124 is in the posture illustrated in FIG. 6, the cylindrical base member 1213*t* of the lever 1213 is pressed by the not-illustrated member, and the lever 1213 rotates around the axis O1 in the direction of an arrow D73 illustrated in FIG. 7, i.e., a direction opposite to the direction of the arrow D41 illustrated in FIG. 4. Accordingly, the upper surface 1213*u* of the projecting portion 1213*a* presses the top plate 1203*u* of the lever receiving member 1203 upward in the +z direction. Therefore, the supply unit 120 rotates around the axis O1 in the direction of the arrow D73. As a result, the supply roller 1201 ascends and separates from the upper surface Pu of the sheets P.

Further, the leading end portion 1213*p* of the lever 1213 ascends and separates from the contact surface 123*s* of the locking member 123. Therefore, the locking member 123 rotates around the axis O2 in the direction of the arrow D42 illustrated in FIG. 4. As a result, the leading end portion 123*p* of the locking member 123 comes into contact with the stopper 124, and the hook-shaped portion of the locking member 123 and the hook-shaped portion of the stopper 124 engage with each other. Thereby, the stopper 124 is fixed, and thus the leading end portions Pa of the sheets P stored in the container are stably aligned. Then, when the lever 1213 reaches a certain position, the foregoing not-illustrated hook-shaped member engages with the cylindrical base member 1213*t*. Therefore, the supply unit 120 is held at the position. Thereby, the supply section 12 returns to the standby state.

According to configurations of related art (Japanese Unexamined Patent Application Publication No. 2002-179274 and U.S. Pat. No. 7,571,905), when a supply unit is lowered, a stopper is released from a locking member in conjunction with the movement of the supply unit. Thus, the stopper is not reliably released before the supply unit starts moving toward a position at which the supply unit comes into contact with media. Therefore, it is required to take a relatively long distance between the supply unit and the uppermost surface of the media to prevent a supply roller of the supply unit from coming into contact with the media before the stopper is released.

Meanwhile, as described above, the stopper 124 of the supply section 12 provided in the image forming apparatus 1 is configured to be released from the load of the locking member 123 before the sheet P is moved by the supply roller 1201. Therefore, the distance between the uppermost surface of the media and the supply unit 120 is shorter than that of the related art, and the image forming apparatus 1 is reduced in size.

2. MODIFIED EXAMPLES

The above is the description of the exemplary embodiment. However, the contents of the exemplary embodiment may be modified as follows. Further, the following modified examples may be combined.

2-1. First Modified Example

In the above-described exemplary embodiment, the lever 1213 is a member including the cylindrical base member 1213*t* covering a side surface of the shaft 1211 and the rod-shaped member 1213*s* radially extending from the cylindrical base member 1213*t*. However, the lever 1213 may be a member having another configuration. For example, the lever 1213 may include a fan-shaped member which rotates around the axis of the shaft 1211. In this case, the configuration may be modified such that, when the fan-shaped member rotates, a linear portion of the fan-shaped member comes into contact with and moves the locking member 123 and releases the stopper 124, and that the fan-shaped member thereafter comes into contact with the lever receiving member 1203 and moves the supply unit 120 to cause the supply roller 1201 to come into contact with the sheet P. That is, it suffices if the lever 1213 is a rotary member which is supported to be rotatable around the axis of the shaft 1211, and which, when rotated, moves the locking member 123 located at a determined position and releases the restriction on the stopper 124 imposed by the locking member 123, and thereafter moves the supply roller 1201 and brings the supply roller 1201 into contact with the sheet P (medium).

2-2. Second Modified Example

In the above-described exemplary embodiment, when the lever 1213 rotates in the direction of the arrow D41 illustrated in FIG. 4, the leading end portion 1213*p* of the lever 1213 comes into contact with the contact surface 123*s* of the locking member 123, and presses the contact surface 123*s* in the −z direction while sliding thereon. However, the drive force accompanying the rotation of the lever 1213 may be transmitted to the locking member 123 by another mode. For example, the lever 1213 and the locking member 123 may be tied together by a string or the like loosened in the standby state. In this case, the configuration may be modified such that, when the lever 1213 rotates, the string is stretched to rotate the locking member 123 in the direction of the arrow D61 illustrated in FIG. 6. That is, the configuration may be modified such that, when the lever 1213 rotates, the lever 1213 moves the locking member 123 before moving the supply roller 1201, to thereby release the restriction on the movement of the stopper 124 imposed by the locking member 123.

2-3. Third Modified Example

Further, in the above-described exemplary embodiment, when the lever 1213 further rotates in the direction of the arrow D41 illustrated in FIG. 4 after the locking member 123 and the stopper 124 separate from each other, the lower surface 1213*b* of the projecting portion 1213*a* hits against the bottom plate 1203*b* of the lever receiving member 1203 and moves the supply unit 120. However, the drive force accompanying the rotation of the lever 1213 may be transmitted to the supply unit 120 by another mode. For example, as described above, the lever 1213 may be tied to the supply unit 120 by a string. That is, it suffices if the lever 1213 is a rotary member which, when rotated, moves the supply roller 1201 and brings the supply roller 1201 into contact with the sheet P. In this case, the string may be extended by an extra length such that the string is loosened in the standby state to allow the lever 1213 to move the locking member 123 before moving the supply roller 1201.

The transmission of the drive force of the lever 1213 is not limited to the string, and the drive force may be transmitted to the locking member 123 or the supply unit 120 by various transmission mechanisms, such as a link mechanism, a gear mechanism, a crank mechanism, and a rack-and-pinion mechanism, for example.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A supply device comprising:

a supply roller that supplies a medium;

a prevention member that, when in a first posture, prevents the medium from being supplied by the supply roller, and that, when in a second posture different from the first posture, allows the medium to be supplied by the supply roller;

a restriction member that, when located at a determined position, restricts a shift of the prevention member from the first posture to the second posture;

a rotatably supported rotary member that comprises first and second projecting portions, when rotated, moves the restriction member located at the determined position by the first projecting portion and releases the restriction on the prevention member imposed by the restriction member, and thereafter moves the supply roller by the second projecting portion and brings the supply roller into contact with the medium; and a lever receiving member configured to receive the second projecting portion, wherein the second projecting portion contacts with the lever receiving member, to move the supply roller, after the first projecting portion contacts to move the restriction member.

2. The supply device according to claim 1, wherein, the prevention member is pressed by the medium and shifted from the first posture to the second posture in response to the supply roller supplying the medium, and is returned to the first posture by the self-weight of the prevention member after the passage of the medium through the prevention member.

3. An image forming apparatus comprising:

the supply device according to claim 1; and an image forming unit configured to form an image on the medium supplied by the supply device.

4. The supply device according to claim 1, further comprising:

a first receiving portion configured to receive the first projecting portion; and a second receiving portion, which is provided at the lever receiving member, configured to receive the second projecting portion, wherein a path between the second projecting portion and second receiving portion is longer than a path between the first projecting portion and the first receiving portion when the prevention member imposed by the restriction member.

5. The supply device according to claim 1 further comprising:

a first receiving portion configured to receive the first projecting portion; and a second receiving portion, which is provided at the lever receiving member, configured to receive the second projecting portion.

* * * * *